United States Patent [19]

Hansen

[11] Patent Number: 4,794,359

[45] Date of Patent: Dec. 27, 1988

[54] VARIABLE TRANSFORMER

[75] Inventor: Ove Hansen, Bogense, Denmark

[73] Assignee: Transpower A/S, Bogense, Denmark

[21] Appl. No.: 144,146

[22] Filed: Jan. 15, 1988

[30] Foreign Application Priority Data

Jan. 19, 1987 [DK] Denmark ..... 268/87

[51] Int. Cl.[4] ..... H01F 15/06; H01F 29/06

[52] U.S. Cl. ..... 336/61; 336/148; 336/149; 338/157

[58] Field of Search ..... 310/229, 230; 338/202, 338/157, 158, 159, 160; 336/137, 148, 149, 61, 55

[56] References Cited

U.S. PATENT DOCUMENTS

| | | | |
|---|---|---|---|
| 1,834,896 | 12/1931 | Bruno | 338/157 |
| 2,000,177 | 5/1935 | Kenney | 338/157 X |
| 2,273,245 | 2/1942 | Ander | 336/149 |

*Primary Examiner*—Thomas J. Kozma
*Attorney, Agent, or Firm*—Sughrue, Mion, Zinn, Macpeak, and Seas

[57] ABSTRACT

A variable transformer comprising an annular core with a winding which at the end surface of the core is provided with a circular contact path to be connected with a current brush mounted on a rotor (7). The current brush consists of a contact roller journalled on a shaft pin (11) which from the rotor (7) is directed obliquely downwardly towards the end surface of the core and inwardly towards the axis thereof. The contact roller includes a double-curved contact path (17) for punctiform contact with the contact path (18) of the winding. The reactive pressure provided by said contact urges the contact roller upwardly along the shaft pin (11) which where secured to the rotor (7) is provided with a contact plate (14) that is in heat-conducting communication with the rotor (7). The contact plate (14) includes a plane circular surface (15) against which a correspondingly plane, circular surface (15') of the contact roller about the bore (12) thereof abuts. The contact roller is delimited by a conical surface the generatrix of which extends from the periphery of the circular surface (15') to the outer periphery of the contact path (17) of the roller. The rotor (7) is bowl-shaped and its top surface shape corresponds to the internal surface of the upper part of a housing for encasing the transformer.

4 Claims, 1 Drawing Sheet

VARIABLE TRANSFORMER

Figure 1:
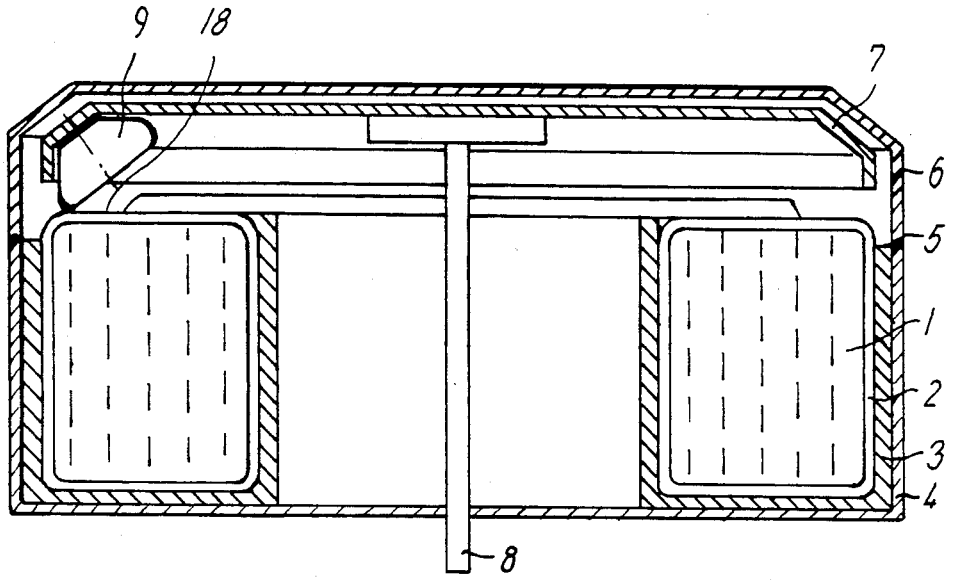

This invention relates to variable transformers comprising an annular core including a winding, the individual turns of which formed from insulated wire in a circular area close to the circumference of the end faces of the core are adjacently arranged and in a section of the circular area are laid open at at least one end to form a circular contact path in such a manner that a current brush which in the form of an electrically conducting contact roller which for the purpose of being mainly punctiformly connected with the contact path is formed so as to curve at the connecting point both in the radial and the tangential direction of the contact path is mounted on a rotor capable of rotating about the axis of the core may be connected with an arbitrary turn.

While the iron losses in a variable transformer are uniformly spread over the iron core of the transformer, other losses, e.g. copper losses in differently loaded winding sections and in individual turns short-circuited by the current brush and resistance losses in the transition between winding and current brush, entail local heating, and the transformer should therefore be dimensioned so that none of the locally heated sections exceeds the critical temperature at which they are weakened, damaged or destroyed.

The most intense local heating occurs at the current brush and it is therefore primarily necessary, when dimensioning the transformer, to pay regard to the cooling of the contact point between the current brush and winding. If a dust-proof and drop-tight encapsulation of the transformer is desired, the cooling will be deteriorated, and a transformer of a determined size stands a lower load.

An attempt has been made to the effect of distributing the load between more brushes operating in parallel, thereby reducing the local heating of the individual brushes, but in order to save space the brushes must extend along contact paths provided on the section of the winding that extneds along the cylindrical external surface of the core. This considerably increases the internal fitting dimensions of the transformer.

In view of the fact that the brush wears off dust and metallic oxides increasing the contact resistance the losses of resistance at the contact point may be reduced by use of a carbon brush. Due to the increasing wear of the winding along the contact path carbon brushes are, however, not applicable in transformers on which heavy demands are made with respect to quality and reliability. In such cases use is made of rolling brushes comprising a contact roller journalled on a shaft of a rotor located above the contact path so as to roll along the contact path upon rotation of the rotor.

Rolling brushes, however, cause vast losses of contact because the contact resistance increases due to dust and metallic oxides on which the contact roller rolls, thereby pushing them down into the contact path. The current supplied shall further be conducted through the narrow linear contact surface between the bore of the contact roller and the shaft on which it is journalled, thereby causing a supplementary heat generation in this place, and heat to be conducted away from the contact roller to the rotor generally provided with cooling surfaces will also pass said narrow linear area.

Accordingly, it is the object of the invention to provide a variable transformer in which the local heating is reduced and the cooling of the locally heated places is more effective than is the case with previous constructions so as to obtain a compact variable transformer that may be encased in a dust-proof and drop-tight housing.

This is obtained by a variable transformer of the type mentioned in the preamble and which according to the invention is characterized in that the contact roller of the current brush is rotatably journalled on a shaft pin which from the rotor located above the contact path is directed obliquely downwardly towards the end surface of the core and inwardly towards the axis thereof, and that the shaft pin where it is secured to the rotor is provided with a contact plate surrounding the pin and being in heat-conducting contact with the rotor and having a plane, circular surface adjacent a corresponding plane, circular surface on the contact roller about the bore thereof.

From DE-OS No. 33 29 353 it is known to journal a contact roller on a shaft pin which from a rotor lcoated above the contact path is directed obliquely downwardly towards the end surface of the core and inwardly towards the axis of said core. The oblique shaft pin is, however, used in this case in connection with a contact roller the contact path of which is shaped as a conical surface in order to obtain a linear contact between the contact roller and the circular contact path of a variable transformer as the contact roller effects a pure rolling along the circular contact path of the transformer.

In a variable transformer according to the invention making use of a rolling brush with double-curved contact path for mainly punctiform contact with the contact path of the transformer it is due to the inclined disposal of the shaft pin of the contact roller that the movement of the rolling brush across the contact path becomes a combined rolling and sliding movement so that the contact path is kept clean without being exposed to excessive wear. The pressure that keeps the contact roller in connection with the contact path causes at the same time the contact roller to be displaced along its supporting pin so that the plane surface about its bore at one end is adjacent to the contact plate at the securing end of the pin. This provides for obtaining a good electrical contact and a good heat transition between the contact roller and rotor.

The inclined journalling of the shaft pin of the contact roller provides for reducing the distance between contact path and rotor and the building height of the transformer is lowered to obtain a more compact unit. This possibility is realized according to the invention in that the contact roller is formed so as to be delimited by a conical surface, the generatrix of which extends from the periphery of the circular surface about the bore of the contact roller to the outer periphery of the contact path of the contact roller.

A protection of the contact roller and the contact path is obtained in that the rotor is shaped as a bowl with downwardly bent edge, and due to the fact that the shaft pin of the contact roller according to the invention is secured at the oblique edge of the rotor the bowl-shaped rotor constitutes an excellent member for dissipation of heat which through the contact surface is transferred to the rotor.

According to the invention the surface of the bowl-shaped rotor remote from the transformer core may have a shape entirely identical with the internal shape of and extending at a short distance from a housing upper part of a housing, the core of the transformer being embedded in the lower part of said housing. This provides for transferring the heat distributed all over the rotor across a vast area by radiation and conduction to the upper part of the housing cooled by the surrounding air.

Figure 2:
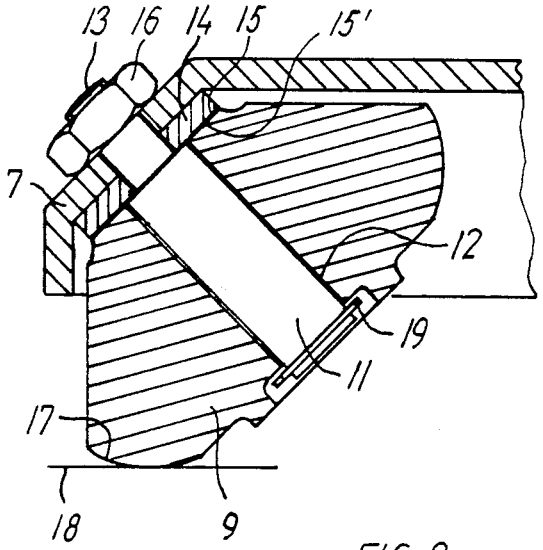

The invention will now be explained in detail with reference to the drawings, in which FIG. 1 is a schematical view of an encased variable transformer according to the invention, and FIG. 2 illustrates, on a larger scale, the rolling brush of the transformer shown in FIG. 1.

FIG. 1 illustrates an encapsulated, variable transformer. An annular core 1 provided with a winding 2 is embedded by a suitable casting mass in a housing lower part 4 which by an intermediate layer of a thermally insulating gasket 5 is sealed with a housing upper part 6. A bowl-shaped rotor 7 is mounted on a shaft 8 coaxial with the core, said shaft being journalled in bearings not shown in detail. A rolling brush 9 is mounted on the rotor 7 in such a manner that on rotation of the shaft 8 and the rotor 7 it moves along a circle across the section of the winding located at the end surface of the core, said winding consisting at this place of juxtaposed turns the insulation of which is ground off along the circle described by the rolling brush 9 to form a contact path for contact between the rolling brush and the individual turns.

FIG. 2 is a section through the rolling brush 9. Said rolling brush consists of a contact roller mounted on a shaft pin 11 passed through a bore 12 within the contact roller. At its upper end the shaft pin 11 has a reduced diameter to form a pin 13 which at its outer end is threaded and which is passed through a circular contact plate 14 and through the downwardly bending edge of the rotor 7 in such a manner that the contact plate 14 on tightening a nut 16 at the outer surface of the downwardly bent collar is urged into intimate heat-conducting contact with the internal surface of the downwardly bent edge of the rotor 7. It is pointed out that the pin 11 and the contact plate 14 may as well be secured to the rotor in some other way, e.g. by riveting the reduced diameter of part 13 at the external surface of the rotor.

The contact plate 14 includes a plane circular contact surface 15 against which the contact roller of the rolling brush abut with an analogously plane circular contact surface 15', the abutting pressure being obtained as the component of the reactive pressure in the direction of the shaft pin when a double-curved contact path 17 on the contact wheel is urged against the plane contact path 18 of the windings. Even though the contact wheel is generally urged in the direction towards the fixing end of the shaft pin 11, the contact wheel in the illustrated embodiment is secured by a locking ring 19 on the free end of the shaft pin 11.

In order to diminish the outer dimensions of the rolling brush the contact roller is bevelled along a line extending from the outer periphery of its contact path 17 to the periphery of the contact surface 15' or, in other words, the contact roller is defined by a conical surface with said line as generatrix.

Even though the oblique direction in the illustrated embodiment forms an angle of about 45° with the axis of the transformer, this is not to be comprehended as confining, since the oblique position may be freely chosen to perform the desired abutting pressure between the contact surfaces. It is desired that said pressure is as high as possible, but it will be restricted by the fact that the friction between the contact paths 17 and 18 must be able to rotate the contact roller about the shaft pin 11 when the transformer is varied.

Experiments carried out by comparing variable transformers having generally known rolling brushes and a variable transformer according to the invention have shown that a rolling brush as mentioned above provides for obtaining an increase of 4 to 5 times the abutting surface between the contact roller and the supporting shaft structure entailing lower thermal and electrical resistance. An amelioration in the range of 40% of the thermal transition from brush to rotor and a reduction in the range of 25% of the electrical losses in the transition between brush and shaft have thus been measured. Said reduction of the heat generated in the brush and the effective conducting-away of the generated heat result in that a traditional transformer of a determined size which freely located just attains sufficient cooling, by the embodiment according to the invention can now without any risk be encased with the advantages obtained thereby, reduced electrical and magnetic radiation, protection of brush and contact path against dust, protection of windings and brush against mechanical stress and so on.

I claim:

1. A variable transformer comprising an annular core with a winding, the individual turns of which formed from insulated wire in a circular area close to the circumference of the end faces of the core are adjacently arranged and in a section of the circular are are laid open at at least one end face to form a circular contact path in such a manner that a current brush which in the form of an electrically conducting contact roller which for the purpose of being mainly punctiformly connected with the contact path is formed so as to curve at the connecting point both in the radial and the tangential direction of the contact path is mounted on a rotor capable of rotating about the axis of the core may be connected with an arbitrary turn, characterized in that the contact roller of the current brush (9) is rotatably journalled on a shaft pin (11) which from the rotor (7) located above the contact path (18) is directed obliquely downwardly towards the end surface of the core and inwardly towards the axis thereof, and that the shaft pin (11) where it is secured to the rotor (7) is provided with a contact plate (14) surrounding the pin and being in heat-conducting contact with the rotor (7) and having a plane, circular surface (15) adjacent a corresponding plane, circular surface (15') on the contact roller about a bore (12) thereof.

2. A variable transformer as claimed in claim 1, characterized in that the contact roller is formed so as to be delimited by a conical surface, the generatrix of which extends from the periphery of the circular surface (15') about the bore (12) of the contact roller to the outer periphery of the contact path (17) of the contact roller.

3. A variable transformer as claimed in claim 1 or 2, characterized in that the rotor is shaped as a bowl with downwardly bent edge, the shaft pin (11) of the contact roller being secured at the downwardly bent edge.

4. A variable transformer as claimed in claim 3, characterized in that the surface of the bowl-shaped rotor remote from the transformer core may have a shape exactly corresponding to the internal shape of and extending at a short distance from a housing upper part of a housing, the core of the transformer being embedded in the lower part of said housing.

* * * * *